US006348905B1

(12) United States Patent
Wang

(10) Patent No.: US 6,348,905 B1
(45) Date of Patent: Feb. 19, 2002

(54) LED DISPLAY APPARATUS

(75) Inventor: Tsun-I Wang, Hsinchu (TW)

(73) Assignee: Dynascan Technology Corporation (TW)

( * ) Notice: Subject to any disclaimer, the term of this patent is extended or adjusted under 35 U.S.C. 154(b) by 0 days.

(21) Appl. No.: 09/651,033

(22) Filed: Aug. 30, 2000

(51) Int. Cl.[7] ..... G09G 3/00

(52) U.S. Cl. ..... 345/31; 345/56; 345/82; 345/86; 40/452; 40/493; 315/169.3; 340/815.4; 340/815.45

(58) Field of Search ..... 345/31, 56, 57, 345/108, 111, 118, 121, 123, 82, 86; 315/169.3; 40/452, 493; 340/815.4, 815.45

(56) References Cited

U.S. PATENT DOCUMENTS 5,057,827 A * 10/1991 Nobile et al. ..... 340/755
5,070,411 A * 12/1991 Suzuki ..... 358/302
5,663,740 A * 9/1997 Brotz ..... 345/6
5,903,224 A * 5/1999 Reynolds ..... 340/815.45
6,175,354 B1 * 1/2001 Blissett et al. ..... 345/110
6,249,998 B1 * 6/2001 Nakamats ..... 40/452

* cited by examiner

*Primary Examiner*—Don Wong
*Assistant Examiner*—Tuyet T. Vo
(74) *Attorney, Agent, or Firm*—Webb Ziesenheim Logsdon Orkin & Hanson, P.C.

(57) ABSTRACT

An LED display apparatus includes an LED display module, an inner frame member, and a supporting unit. The LED display module has an array of light emitting diodes mounted thereon, and a longitudinal axis. The inner frame member is disposed to confine the LED display module therein, and has a size sufficient to permit movement of the LED display module in opposite directions of the longitudinal axis. The supporting unit mounts the LED display module in the inner frame member such that the LED display module is movable back and forth in the inner frame member along the longitudinal axis.

15 Claims, 2 Drawing Sheets

LED DISPLAY APPARATUS

BACKGROUND OF THE INVENTION

1. Field of the Invention

The invention relates to an LED display apparatus, more particularly to an LED display apparatus that can minimize the number of light emitting diodes used to display image frames so as to reduce the incurred costs.

2. Description of the Related Art

A conventional LED display apparatus is used as a display screen. The higher the resolution of the display screen, the greater will be the number of light emitting diodes that is required. As such, hundreds of thousand of sets of red, green and blue LEDs are needed to compose a display screen, thereby resulting in substantially high costs.

SUMMARY OF THE INVENTION

Therefore, the object of the present invention is to provide an LED display apparatus that can minimize the number of light emitting diodes used to display image frames so as to reduce the incurred costs.

According to the present invention, an LED display apparatus includes an LED display module, an inner frame member, supporting means, and biasing means.

The LED display module has an array of light emitting diodes mounted thereon, and a longitudinal axis.

The inner frame is disposed to confine the LED display module therein, and has a size sufficient to permit movement of the LED display module in opposite directions of the longitudinal axis.

The supporting means mounts the LED display module in the inner frame member such that the LED display module is movable back and forth in the inner frame member along the longitudinal axis.

The biasing means, which is disposed between the inner frame member and the LED display module, provides a biasing force to the LED display module in the opposite directions of the longitudinal axis.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
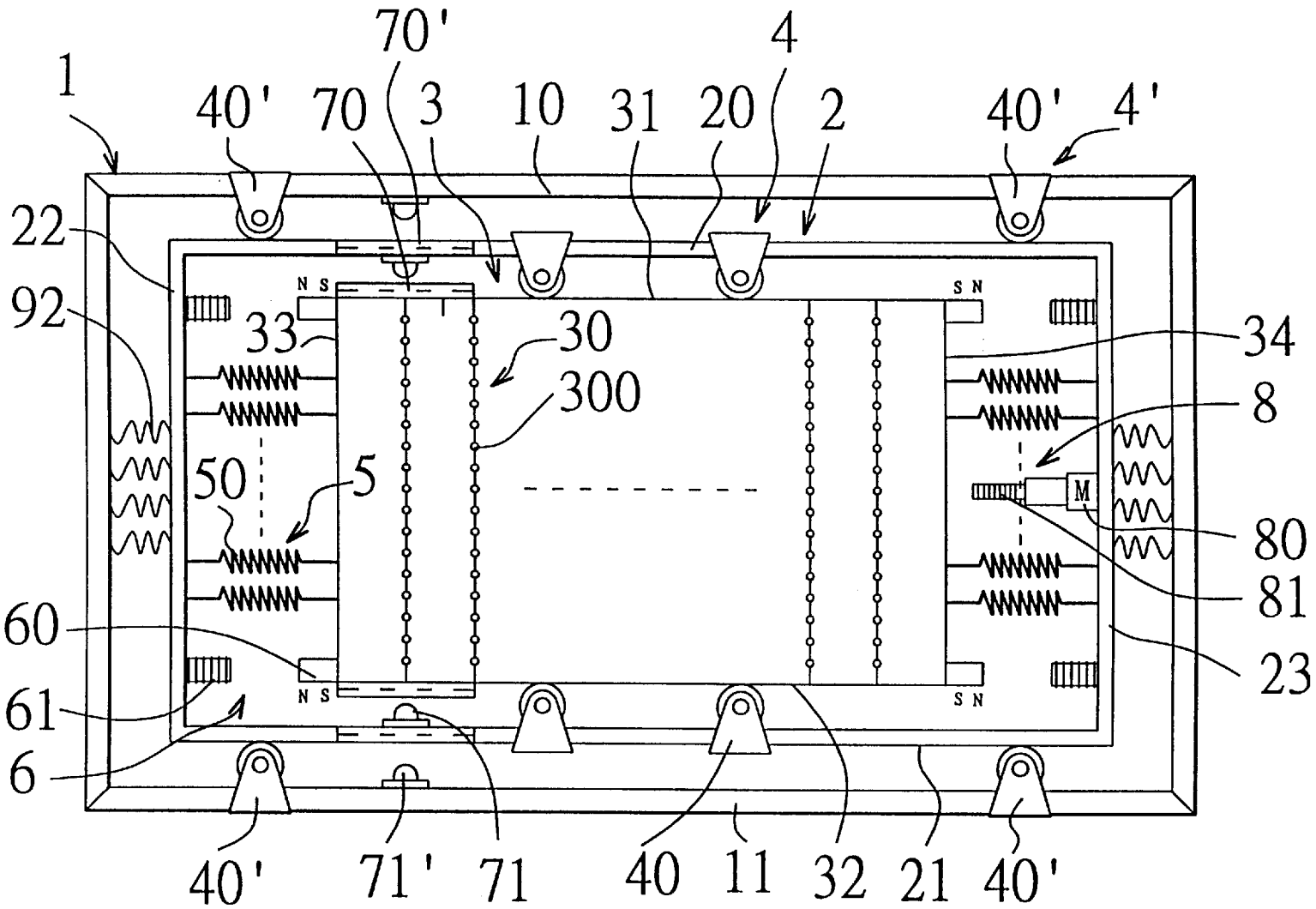
FIG. 1 is a front schematic view showing the preferred embodiment of an LED display apparatus according to this invention.
Figure 2:
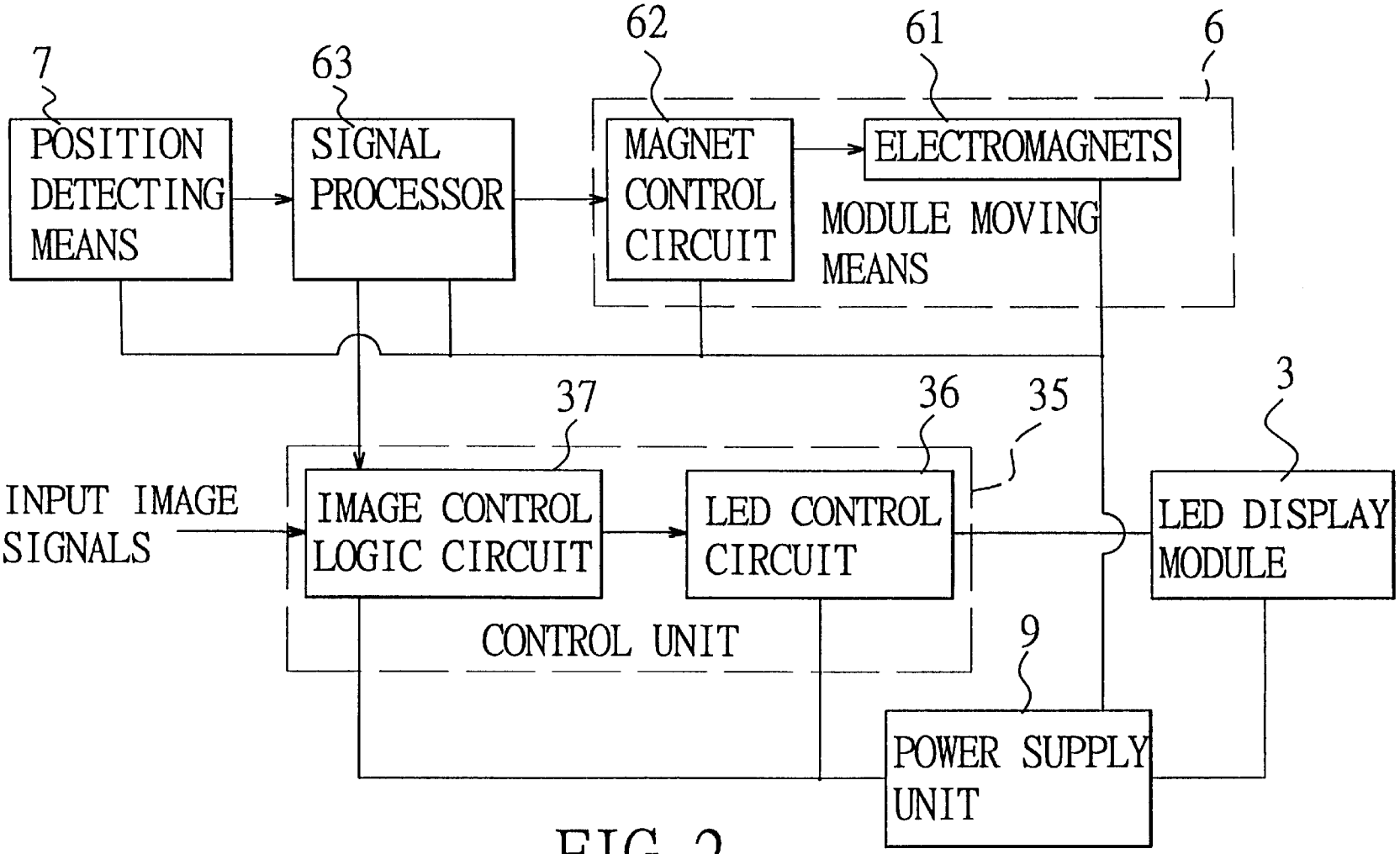
FIG. 2 is a schematic circuit block diagram illustrating the preferred embodiment.

Referring to FIGS. 1 and 2, according to the preferred embodiment of this invention, an LED display apparatus is shown to include an LED display module 3, an inner frame member 2, first supporting means 4, biasing means 5, module moving means 6, an outer frame member 1, second supporting means 4', position detecting means 7, a signal processor 63, a control unit 35, a positioning device 8, and a power supply unit 9.

The LED display module 3 has an array of LEDs 300 mounted thereon, and a longitudinal axis. The array of LEDs 300 consists of a plurality of parallel strips 30 of LEDs 300.

The strips 30 of LEDs 300 are arranged spacedly along the longitudinal axis at equal intervals . Each of the strips of LEDs 300 includes a plurality of sets of red, green and blue LEDs 300. The LED display module 3 has upper and lower edges 31, 32 that extend parallel to the longitudinal axis, and left and right edges 33, 34 that are transverse to the longitudinal axis.

The inner frame member 2 is disposed to confine the LED display module 3 therein, and has a size sufficient to permit movement of the LED display module 3 in opposite directions of the longitudinal axis. The inner frame member 2 has upper and lower frame parts 20, 21 that extend parallel to and that are disposed adjacent to the upper and lower edges 31, 32 of the LED display module 3, respectively, and left and right frame parts 22, 23 that extend parallel to and that are disposed adjacent to the left and right edges 33, 34 of the LED display module 3, respectively.

The first supporting means 4 mounts the LED display module 3 in the inner frame member 2 such that the LED display module 3 is movable back and forth in the inner frame member 2 along the longitudinal axis and such that the LED display module 3 is incapable of moving in directions that are transverse to the longitudinal axis. The first supporting means 4 includes a plurality of roller units 40 mounted on the upper and lower frame parts 20, 21 and in rolling contact with an adjacent one of the upper and lower edges 31, 32 of the LED display module 3. Alternatively, the first supporting means 4 can be implemented using magnetic levitation techniques.

The biasing means 5, which is disposed between the inner frame member 2 and the LED display module 3, provides a biasing force to the LED display module 3 in the opposite directions of the longitudinal axis. The biasing means 5 includes a plurality of coiled springs 50 disposed between a respective one of the left and right frame parts 22, 23 of the inner frame member 2 and an adjacent one of the left and right edges 33, 34 of the LED display module 3. Alternatively, the biasing means 5 can be implemented with the use of magnets.

The module moving means 6, which is disposed between the inner frame member 2 and the LED display module 3, moves the LED display module 3 in opposite directions of the longitudinal axis against biasing action of the biasing means 5. The module moving means 6 includes a plurality of permanent magnets 60 mounted on the left and right edges 33, 34 of the LED display module 3, a plurality of electromagnets 61 mounted on the left and right frame parts 22, 23 of the inner frame member 2, and a magnet control circuit 62 connected electrically to the electromagnets 61 and operable so as to control the electromagnets 61 to attract with and to repel from the permanent magnets 60, such as by controlling magnitude and direction of current to the electromagnets 61, thereby moving the LED display module 3 in the opposite directions of the longitudinal axis against the biasing action of the biasing means 5.

The outer frame member 1, which is made from metal, is disposed to confine the inner frame member 2 therein, and has a size sufficient to permit movement of the inner frame member 2 in the opposite directions of the longitudinal axis. The outer frame member 1 has upper and lower frame parts 10, 11 that extend parallel to and that are disposed adjacent to the upper and lower frame parts 20, 21 of the inner frame member 2, respectively.

The second supporting means 4' mounts the inner frame member 2 in the outer frame member 1 such that the inner frame member 2 is movable back and forth in the longitudinal axis and such that the inner frame member 2 is incapable of moving in directions that are transverse to the longitudinal axis. The second supporting means 4' includes a plurality of roller units 40' mounted on the upper and lower frame parts 10, 11 of the outer frame member 1 and in rolling contact with an adjacent one of the upper and lower frame parts 20, 21 of the inner frame member 2.

The position detecting means 7 detects the position of the LED display module 3 in the inner frame member 2, and the position of the inner frame member 2 in the outer frame member 1. The position detecting means 7 includes a pair of first position markers 70 provided on the upper and lower edges 31, 32 of the LED display module, respectively, a pair of second position markers 70' provided on the upper and lower frame parts 20, 21 of the inner frame member 2, respectively, a pair of first position sensors 71 provided on the upper and lower frame parts 20, 21 of the inner frame member 2, respectively, for sensing movement of the first position markers 70, and a pair of second position sensors 71' provided on the upper and lower frame parts 10, 11 of the outer frame member 1, respectively, for sensing movement of the second position markers 70'. In this embodiment, the first and second position markers 70, 70' employ gray bar codes, and the first and second position sensors 71, 71' are bar code readers, such as charge-coupled sensing devices.

The signal processor 63 is connected to the position detecting means 7 and the module moving means 6. The signal processor 63 receives position data generated by the position detecting means 7, and generates control signals provided to the module moving means 6. The magnet control circuit 62 receives the control signals generated by the signal processor 63 so as to control movement of the LED display module 3 in the inner frame member 2.

The control unit 35 includes an image control logic circuit 37 connected to the signal processor 63, and an LED control circuit 36 connected to the image control logic circuit 37. The LED control circuit 36 is further connected to the LED display module 3 via a flexible printed circuit. The image control logic circuit 37 receives the position data from the signal processor 63, and is adapted to receive input image signals so as to generate image control signals in accordance with the position data. The LED control circuit 36 receives the image control signals generated by the image control logic circuit 37, and controls the LEDs 300 of the LED display module 3 so that image frames can be shown by the LED display module 3 while the LED display module 3 moves back and forth in the inner frame member 2 along the longitudinal axis.

The positioning device 8 is mounted on the right frame part 23 of the inner frame member 2, and is operable so as to move the LED display module 3 to an initial starting position. The positioning device 8 includes a motor 80 and a push rod 81 driven by the motor 80 to push the LED display module 3 to the initial starting position.

The power supply unit 9 is connected electrically to the position detecting means 7, the signal processor 63, the module moving means 6, the control unit 35, and the LED display module 3 via the biasing means 5 and a plurality of conductive coil springs 92 between the inner and outer frame members 2, 1.

In actual use, the weight of the inner frame member 2 is much greater than that of the LED display module 3. The degree of movement of the LED display module 3 relative to the inner frame member 2 is thus greater than that of the inner frame member 2 relative to the outer frame member 1. According to Hooke's law, frequency of movement of the LED display module 3 along the longitudinal axis between a first predetermined position, such as the initial starting position, and a second predetermined position in relation to the effective mass of the LED display module 3 and the inner frame member 2 can be determined according to the following Equations 1 and 2:

$$M_e = M*m/(M+m) \quad \text{(Equation 1)}$$

$$f = 1/(2\pi)*K/M_e \quad \text{(Equation 2)}$$

where "M" is the mass of the inner frame member 2, "m" is the mass of the LED display module, "$M_e$" is the effective mass of the inner frame member 2 and the LED display module 3, "f" is the frequency of movement of the LED display module 3, and "K" is the elasticity coefficient of the coiled springs 50.

If the distance between the first and second determined positions is equal to two intervals of continuous three strips 30, the frequency (f) has to be greater than six times per second to obtain a stable picture since vision persistence for the human eye is less than 1/24 second. Therefore, the elasticity coefficient of the coiled springs 50 can be selected according to meet the desired frequency (f).

Due to the presence of the module moving means 6 and the position detecting means 7, the LED display module 3 can be controlled to move back and forth between the first and second predetermined positions along the longitudinal axis.

It is noted that, in this invention, the strips 30 of LEDs 300 showing the image frames while the LED display module 3 moves back and forth along the longitudinal axis can present pictures comparable to those shown by a plurality of strips of LEDs in the aforesaid conventional LED display apparatus, thereby minimizing the number of LEDs in use so as to reduce the incurred costs. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

wherein said LED display module has upper and lower edges that extend parallel to the longitudinal axis;

said inner frame member has upper and lower frame parts that extend parallel to and that are disposed adjacent to said upper and lower edges of said LED display module, respectively; and said first supporting means includes a plurality of roller units mounted on said upper and lower frame parts and in rolling contact with an adjacent one of said upper and lower edges of said LED display module.

2. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

a biasing means, disposed between said inner frame member and said LED display module, for providing a biasing force to said LED display module in the opposite directions of the longitudinal axis;

said LED display module has left and right edges that are transverse to the longitudinal axis;

said inner frame member has left and right frame parts that extend parallel to and that are disposed adjacent to said left and right edges of said LED display module, respectively; and said biasing means includes a plurality of coiled springs disposed between a respective one of said left and right frame parts of said inner frame member and an adjacent one of said left and right edges of said LED display module.

3. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

an outer frame member that is disposed to confine said inner frame member therein and that has a size sufficient to permit movement of said inner frame member in the opposite directions of the longitudinal axis;

second supporting means for mounting said inner frame member in said outer frame member such that said inner frame member is movable back and forth in said outer frame member along the longitudinal axis;

said inner frame member has upper and lower frame parts that extend parallel to the longitudinal axis;

said outer frame member has upper and lower frame parts that extend parallel to and that are disposed adjacent to said upper and lower frame parts of said inner frame member, respectively; and said second supporting means includes a plurality of roller units mounted on said upper and lower frame parts of said outer frame member and in rolling contact with an adjacent one of said upper and lower frame parts of said inner frame member.

4. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

a biasing means, disposed between said inner frame member and said LED display module, for providing a biasing force to said LED display module in the opposite directions of the longitudinal axis;

module moving means, disposed between said inner frame member and said LED display module, for moving said LED display module in the opposite directions of the longitudinal axis against biasing action of said biasing means;

said LED display module has left and right edges that are transverse to the longitudinal axis;

said inner frame member has left and right frame parts that extend parallel to and that are disposed adjacent to said left and right edges of said LED display module, respectively; and said module moving means includes a plurality of first magnet members mounted on said left and right edges of said LED display module, and a plurality of second magnet members mounted on said left and right frame parts of said inner frame member.

5. The LED display apparatus of claim 4, wherein said first magnet members are permanent magnets, and said second magnet members are electromagnets.

6. The LED display apparatus of claim 4, wherein one of said plurality of first and second magnet members includes a plurality of permanent magnets, and the other one of said plurality of first and second magnet members includes a plurality of electromagnets.

7. The LED display apparatus of claim 6, wherein said module moving means further includes a magnet control circuit connected electrically to said electromagnets and operable so as to control said electromagnets to attract with and to repel from said permanent magnets, thereby moving said LED display module in the opposite directions of the longitudinal axis against the biasing action of said biasing means.

8. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

a biasing means, disposed between said inner frame member and said LED display module, for providing a biasing force to said LED display module in the opposite directions of the longitudinal axis;

module moving means, disposed between said inner frame member and said LED display module, for moving said LED display module in the opposite directions of the longitudinal axis against biasing action of said biasing means; and position detecting means for detecting position of said LED display module in said inner frame member.

9. The LED display apparatus of claim 8, wherein said position detecting means includes a position marker provided on one of said LED display module and said inner frame member, and a position sensor provided on the other one of said LED display module and said inner frame member for sensing movement of said position marker.

10. The LED display apparatus of claim 8, further comprising a signal processor connected to said position detecting means and said module moving means, said signal processor receiving position data generated by said position detecting means and generating control signals provided to said module moving means so as to control movement of said LED display module in said inner frame member.

11. The LED display apparatus of claim 10, further comprising a control unit connected to said signal processor and said LED display module, said control unit receiving said position data from said signal processor and being adapted to receive input image signals, said control unit controlling said diodes of said LED display module so that image frames can be shown by said LED display module while said LED display module moves back and forth in said inner frame member along the longitudinal axis.

12. An LED display apparatus comprising:

an LED display module having an array of light emitting diodes mounted thereon, said LED display module having a longitudinal axis;

an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

an outer frame member that is disposed to confine said inner frame member therein and that has a size sufficient to permit movement of said inner frame member in the opposite directions of the longitudinal axis;

second supporting means for mounting said inner frame member in said outer frame member such that said inner frame member is movable back and forth in said outer frame member along the longitudinal axis;

a biasing means, disposed between said inner frame member and said LED display module, for providing a biasing force to said LED display module in the opposite directions of the longitudinal axis;

module moving means, disposed between said inner frame member and said LED display module, for moving said LED display module in the opposite directions of the longitudinal axis against biasing action of said biasing means; and position detecting means for detecting position of said LED display module in said inner frame member, and position of said inner frame member in said outer frame member.

13. The LED display apparatus of claim 12, wherein said position detecting means includes a first position marker provided on one of said LED display module and said inner frame member, a second position marker provided on one of said inner frame member and said outer frame member, a first position sensor provided on the other one of said LED display module and said inner frame member for sensing movement of said first position marker, and a second position sensor provided on the other one of said inner frame member and said outer frame member for sensing movement of said second position marker.

14. An LED display apparatus comprising:

an LED display module having an array of light emitting diodes mounted thereon, said LED display module having a longitudinal axis, an inner frame member that is disposed to confine said LED display module therein and that has a size sufficient to permit movement of said LED display module in opposite directions of the longitudinal axis;

first supporting means for mounting said LED display module in said inner frame member such that said LED display module is movable back and forth in said inner frame member along the longitudinal axis;

a biasing means, disposed between said inner frame member and said LED display module, for providing a biasing force to said LED display module in the opposite directions of the longitudinal axis; and a positioning device mounted on said inner frame member and operable so as to move said LED display module to an initial starting position.

15. The LED display apparatus of claim 14, wherein said positioning device includes a motor and a push rod driven by said motor to push said LED display module to the initial starting position.

* * * * *